US009033056B2

(12) United States Patent
Acosta et al.

(10) Patent No.: US 9,033,056 B2
(45) Date of Patent: May 19, 2015

(54) PRESSURE ACTIVATED DOWN HOLE SYSTEMS AND METHODS

(75) Inventors: Frank Acosta, Duncan, OK (US); Nicholas F. Budler, Marlow, OK (US); David D. Szarka, Duncan, OK (US)

(73) Assignee: Halliburton Energy Srvices, Inc., Houston, TX (US)

( * ) Notice: Subject to any disclaimer, the term of this patent is extended or adjusted under 35 U.S.C. 154(b) by 243 days.

(21) Appl. No.: 13/585,954

(22) Filed: Aug. 15, 2012

(65) Prior Publication Data

US 2014/0048281 A1 Feb. 20, 2014

(51) Int. Cl.

| | |
|---|---|
| ***E21B 23/04*** | (2006.01) |
| ***E21B 23/06*** | (2006.01) |
| ***E21B 33/00*** | (2006.01) |
| ***E21B 33/128*** | (2006.01) |
| ***E21B 41/00*** | (2006.01) |

(52) U.S. Cl.

CPC ..... *E21B 23/06* (2013.01); *E21B 23/04* (2013.01); *E21B 33/00* (2013.01); *E21B 33/128* (2013.01); *E21B 41/00* (2013.01)

(58) Field of Classification Search

CPC ..... E21B 23/00; E21B 23/06; E21B 23/04; E21B 33/00

USPC ..... 166/373, 381, 383, 387

See application file for complete search history.

(56) References Cited

U.S. PATENT DOCUMENTS

| | | | | |
|---|---|---|---|---|
| 4,039,031 | A | 8/1977 | Crowe | |
| 4,660,637 | A | 4/1987 | McGill et al. | |
| 5,058,674 | A | 10/1991 | Schultz et al. | |
| 5,433,269 | A | 7/1995 | Hendrickson | |
| 2002/0121373 | A1 | 9/2002 | Patel | |
| 2004/0007366 | A1 * | 1/2004 | McKee et al. | 166/387 |
| 2004/0035591 | A1 | 2/2004 | Echols | |
| 2008/0083541 | A1 | 4/2008 | Butterfield et al. | |
| 2008/0210429 | A1 | 9/2008 | McMillin et al. | |
| 2009/0229832 | A1 | 9/2009 | King | |
| 2009/0272544 | A1 | 11/2009 | Giroux et al. | |
| 2009/0321081 | A1 | 12/2009 | Schramm et al. | |
| 2010/0084130 | A1 | 4/2010 | Richards et al. | |

FOREIGN PATENT DOCUMENTS

WO 2014107395 A1 7/2014

OTHER PUBLICATIONS

International Search Report and Written Opinion for PCT/US2013/077821 dated Apr. 17, 2014.

International Search Report and Written Opinion for PCT/US2013/053552 dated Oct. 14, 2014.

* cited by examiner

*Primary Examiner* — Brad Harcourt

(74) *Attorney, Agent, or Firm* — McDermott Will & Emery LLP; John W. Wustenberg

(57) ABSTRACT

Systems and methods for activating a down hole tool in a wellbore. A piston is moveable from a first position to a second position for activating the down hole tool. The piston includes a first side exposed to a first chamber, and a second side exposed to a second chamber. A rupture member has a first side exposed to the first chamber and a second side exposed to a third chamber. The rupture member is configured to rupture when a pressure differential between the first chamber and the third chamber reaches a predetermined threshold value, at which point the rupture member allows fluid communication between the first chamber and the third chamber. When the rupture member is intact, the piston is in the first position, and when the rupture member ruptures, the piston moves to the second position and activates the down hole tool.

18 Claims, 3 Drawing Sheets

PRESSURE ACTIVATED DOWN HOLE SYSTEMS AND METHODS

BACKGROUND

The present invention relates to systems and methods used in down hole applications. More particularly, the present invention relates to the setting of a down hole tool in various down hole applications using pressure differentials between various fluid chambers surrounding or in the vicinity of the down hole tool.

In the course of treating and preparing a subterranean well for production, down hole tools, such as well packers, are commonly run into the well on a tubular conveyance such as a work string, casing string, or production tubing. The purpose of the well packer is not only to support the production tubing and other completion equipment, such as sand control assemblies adjacent to a producing formation, but also to seal the annulus between the outside of the tubular conveyance and the inside of the well casing or the wellbore itself. As a result, the movement of fluids through the annulus and past the deployed location of the packer is substantially prevented.

Some well packers are designed to be set using complex electronics that often fail or may otherwise malfunction in the presence of corrosive and/or severe down hole environments. Other well packers require that a specialized plug or other wellbore device be sent down the well to set the packer. While reliable in some applications, these and other methods of setting well packers add additional and unnecessary complexity and cost to the pack off process.

SUMMARY

The present invention relates to systems and methods used in down hole applications. More particularly, the present invention relates to the setting of a down hole tool in various down hole applications using pressure differentials between various fluid chambers surrounding or in the vicinity of the down hole tool.

In some aspects, a system for activating a down hole tool in a wellbore includes a piston moveable from a first position to a second position for activating the down hole tool. The piston includes a first piston side exposed to a first chamber, and a second piston side exposed to a second chamber. A rupture member is provided and has a first member side exposed to the first chamber and a second member side exposed to a third chamber. The rupture member is configured to prevent fluid communication between the first chamber and the third chamber only until a pressure differential between the first chamber and the third chamber reaches a predetermined threshold value, at which point the rupture member ruptures and allows fluid communication between the first chamber and the third chamber. When the pressure differential is below the threshold value and the rupture member is intact, the piston is in the first position, and when the pressure differential reaches the threshold value and the rupture member ruptures, the piston moves to the second position and activates the down hole tool.

In other aspects, a method is provided for activating a down hole tool in a wellbore. The down hole tool is coupled to a base pipe positioned within the wellbore and the base pipe cooperates with an inner surface of the wellbore to define an annulus. The method includes advancing the tool into the wellbore to a location in the annulus, and increasing pressure in the annulus to a pressure above a threshold value, which ruptures a rupture member and creates a pressure differential between a first chamber on a first side of a movable piston and a second chamber on a second side of the movable piston. The piston moves in response to the pressure differential to activate the down hole tool.

In yet other aspects, a wellbore system includes a base pipe moveable along the wellbore. The base pipe includes a sleeve assembly defining a first chamber, a second chamber, and a third chamber. A moveable piston fluidly separates the first chamber and the second chamber. A down hole tool is disposed about the base pipe. The down hole tool is operatively coupled to the piston and is operable in response to movement of the piston. A rupture member fluidly separates the first chamber from the third chamber only until a pressure differential between the first chamber and the third chamber reaches a predetermined threshold value, at which point the rupture member ruptures and allows fluid communication between the first chamber and the third chamber, thereby reducing pressure in the first chamber and causing the piston to move toward the first chamber to operate the down hole tool.

Features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

The present invention relates to systems and methods used in down hole applications. More particularly, the present invention relates to the setting of a down hole tool in various down hole applications using pressure differentials between various fluid chambers surrounding or in the vicinity of the down hole tool.

Systems and methods disclosed herein can be configured to activate and set a down hole tool, such as a well packer, in order to isolate the annular space defined between a wellbore and a base pipe (e.g., production string), thereby helping to prevent the migration of fluids through a cement column and to the surface. Other applications will be readily apparent to those skilled in the art. Systems and methods are disclosed that permit the down hole tool to be hydraulically-set without the use of electronics, signaling, or mechanical means. The systems and methods take advantage of pressure differentials between, for example, the annular space between the wellbore and the base pipe and one or more chambers formed in or around the tool itself and/or the base pipe. Consequently, the disclosed systems and methods simplify the setting process and reduce potential problems that would otherwise prevent the packer or down hole tool from setting. To facilitate a better understanding of the present invention, the following examples are given. It should be noted that the examples provided are not to be read as limiting or defining the scope of the invention.

Figure 1:
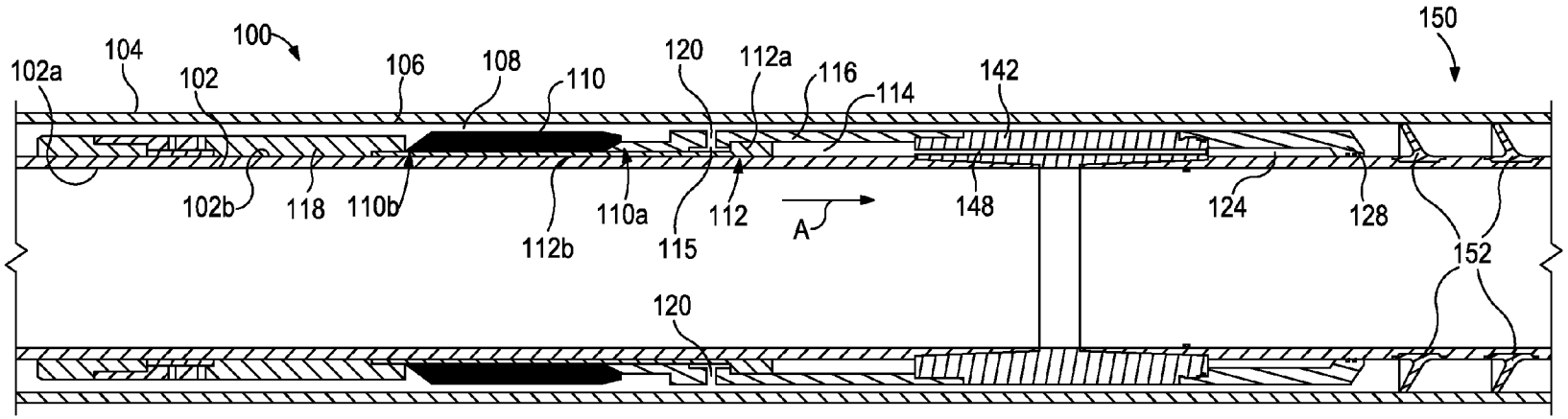
FIG. 1 illustrates a cross-sectional view of a portion of a base pipe and accompanying activation system, according to one or more embodiments disclosed.

Referring to FIG. 1, illustrated is a cross-sectional view of an exemplary activation system 100, according to one or more embodiments. The system 100 may include a base pipe 102 extending within a wellbore 104 that has been drilled into the Earth's surface to penetrate various earth strata containing, for example, hydrocarbon formations. It will be appreciated that the system 100 is not limited to any specific type of well, but may be used in all types, such as vertical wells, horizontal wells, multilateral (e.g., slanted) wells, combinations thereof, and the like. A casing 106 may be disposed within the wellbore 104 and thereby define an annulus 108 between the casing 106 and the base pipe 102. The casing 106 forms a protective lining within the wellbore 104 and may be made from materials such as metals, plastics, composites, or the like. In some embodiments, the casing 106 may be expanded or unexpanded as part of an installation procedure and/or may be segmented or continuous. In at least one embodiment, the casing 106 may be omitted and the annulus 108 may instead be defined between the inner wall of the wellbore 104 and the base pipe 102.

The base pipe 102 may include one or more tubular joints, having metal-to-metal threaded connections or otherwise threadedly joined to form a tubing string. In other embodiments, the base pipe 102 may form a portion of a coiled tubing. The base pipe 102 may have a generally tubular shape, with an inner radial surface 102*a* and an outer radial surface 102*b* having substantially concentric and circular cross-sections. However, other configurations may be suitable, depending on particular conditions and circumstances. For example, some configurations of the base pipe 102 may include offset bores, sidepockets, etc. The base pipe 102 may include portions formed of a non-uniform construction, for example, a joint of tubing having compartments, cavities or other components therein or thereon. Moreover, the base pipe 102 may be formed of various components, including, but not limited to, a joint casing, a coupling, a lower shoe, a crossover component, or any other component known to those skilled in the art. In some embodiments, various elements may be joined via metal-to-metal threaded connections, welded, or otherwise joined to form the base pipe 102. When formed from casing threads with metal-to-metal seals, the base pipe 102 may omit elastomeric or other materials subject to aging, and/or attack by environmental chemicals or conditions.

The system 100 may further include at least one down hole tool 110 coupled to or otherwise disposed about the base pipe 102. In some embodiments, the down hole tool 110 may be a well packer. In other embodiments, however, the down hole tool 110 may be a casing annulus isolation tool, a stage cementing tool, a multistage tool, formation packer shoes or collars, combinations thereof, or any other down hole tool. As the base pipe 102 is run into the well, the system 100 may be adapted to substantially isolate the down hole tool 110 from any fluid actions from within the casing 106, thereby effectively isolating the down hole tool 110 so that circulation within the annulus 108 is maintained until the down hole tool 110 is actuated.

In one or more embodiments, the down hole tool 110 may include a standard compression-set element that expands radially outward when subjected to compression. Alternatively, the down hole tool 110 may include a compressible slip on a swellable element, a compression-set element that partially collapses, a ramped element, a cup-type element, a chevron-type seal, one or more inflatable elements, an epoxy or gel introduced into the annulus 108, combinations thereof, or other sealing elements.

The down hole tool 110 may be disposed about the base pipe 102 in a number of ways. For example, in some embodiments the down hole tool 110 may directly or indirectly contact the outer radial surface 102*b* of the base pipe 102. In other embodiments, however, the down hole tool 110 may be arranged about or otherwise radially-offset from another component of the base pipe 102.

Figure 2:
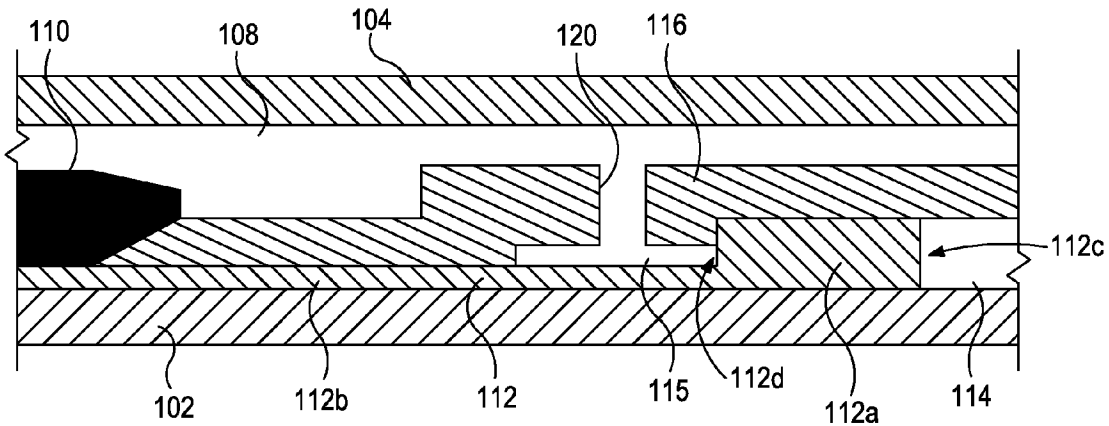
FIG. 2 illustrates an enlarged view of a portion of the activation system shown in FIG. 1.

Referring also to FIG. 2, the system 100 may include a piston 112 arranged external to the base pipe 102. As illustrated, the piston 112 may include an enlarged piston portion 112*a* and a stem portion 112*b* that extends axially from the piston portion 112*a* and between the down hole tool 110 and the base pipe 102. The piston portion 112*a* includes a first side 112*c* exposed to and delimiting a first chamber 114, and a second side 112*d* exposed to and delimiting a second chamber 115. Both the first chamber 114 and the second chamber 115 may be at least partially defined by a retainer element 116 arranged about the base pipe 102 adjacent a first axial end 110*a* (FIG. 1) of the down hole tool 110. In the illustrated embodiment, one or more inlet ports 120 may be defined in the retainer element 116 and provide fluid communication between the annulus 108 and the second chamber 115. In other embodiments, the second side 112*d* of the piston portion 112*a* may be exposed directly to the annulus 108. The stem portion 112*b* may be coupled to a compression sleeve 118 (FIG. 1) arranged adjacent to, and potentially in contact with, a second axial end 110*b* of the down hole tool 110.

As discussed below, the piston 112 is moveable in response to the creation of pressure differentials across the piston portion 112*a* in order to set the down hole tool 110. In one embodiment, a pressure differential experienced across the piston portion 112*a* forces the piston 112 to translate axially within the first chamber 114 in a direction A as it seeks pressure equilibrium. As the piston 112 translates in direction A, the compression sleeve 118 coupled to the stem portion 112*b* is forced up against the second axial end 110*b* of the down hole tool 110, thereby compressing and radially expanding the down hole tool 110. As the down hole tool 110 expands radially, it may engage the wall of the casing 106 and effectively isolate portions of the annulus 108 above and below the down hole tool 110.

As noted above, the second chamber 115 communicates with the annulus 108 via the ports 120 and therefore contains annular fluid substantially at the same hydrostatic pressure that is present in the annulus 108. Thus, as the system 100 is advanced into the wellbore 104 and moves downwardly into the Earth, hydrostatic pressure in the annulus 108 and the corresponding pressure in the second chamber 115 both increase. The first chamber 114 is also filled with fluid, such as, for example, hydraulic fluid, water, oil, combinations thereof, or the like. As the system 100 is advanced into the wellbore 104, the piston portion 112*a* may be configured to transmit the pressure in the second chamber 115 to the fluid in the first chamber 114 such that the second chamber 115 and the first chamber 114 remain in substantial fluid equilibrium, and the piston 112 thereby remains substantially stationary.

Figure 3:
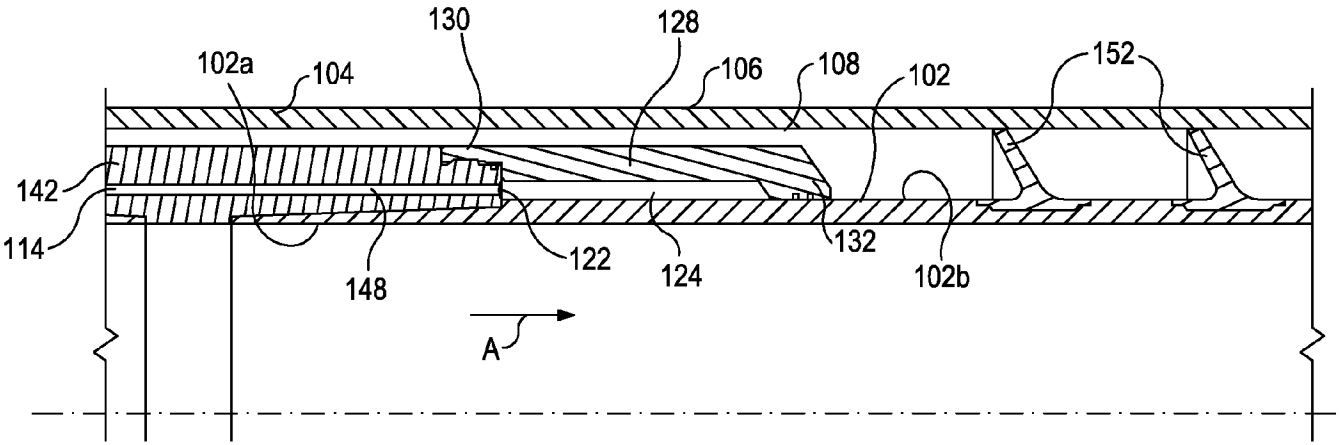
FIG. 3 illustrates an enlarged view of another portion of the activation system shown in FIG. 1.
Figure 4:
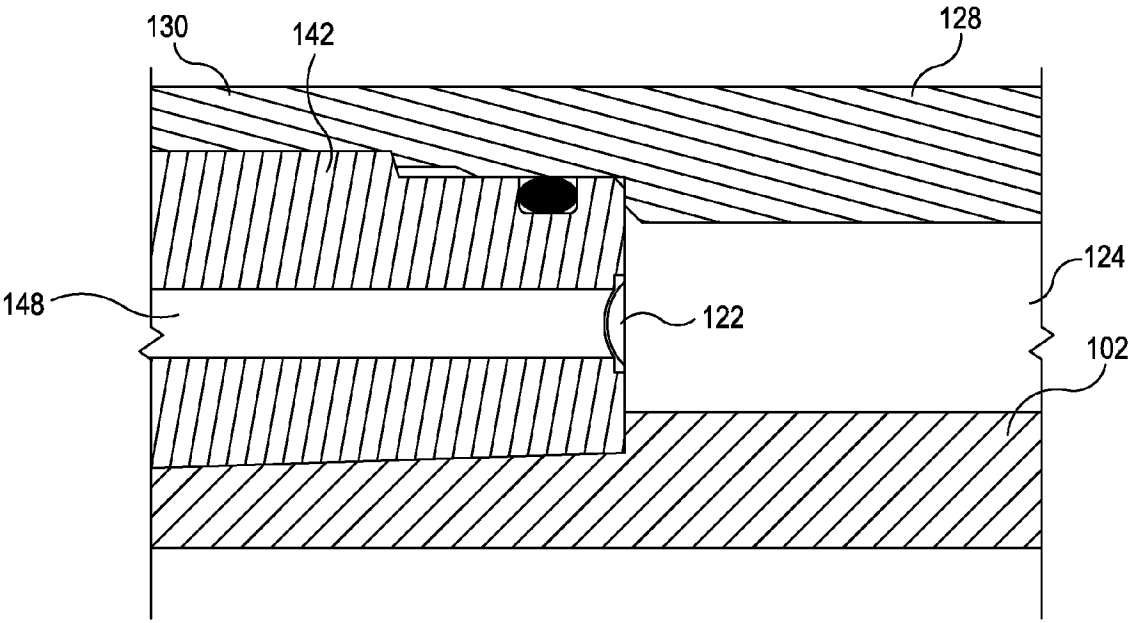
FIG. 4 illustrates a further enlarged view of the portion of the activation system shown in FIG. 3.

Referring also to FIGS. 3 and 4, the system 100 may further include a rupture member 122. In some embodiments, the rupture member 122 may rupture when subjected to a predetermined threshold pressure differential, and rupturing of the rupture member 122 may in turn establish a pressure differential across the piston portion 112*a* (FIGS. 1 and 2) sufficient to translate the piston 112 in the direction A, thereby causing the down hole tool 110 to set. The rupture member 122 may be or include, among other things, a burst disk, an elastomeric seal, a metal seal, a plate having an area of reduced cross section, a pivoting member held in a closed position by shear pins designed to fail in response to a predetermined shear load, an engineered component having built-in stress risers of a particular configuration, and/or substantially any other component that is specifically designed to rupture or fail in a controlled manner when subjected to a predetermined threshold pressure differential. The rupture member 122 functions substantially as a seal between isolated chambers only until a pressure differential between the isolated chambers reaches the predetermined threshold value, at which point the rupture member fails, bursts, or otherwise opens to allow fluid to flow from the chamber at higher pressure into the chamber at lower pressure. The specific size, type, and configuration of the rupture member 122 generally is chosen so the rupture member 122 will rupture at a desired pressure differential. The desired pressure differential is often associated with the desired depth at which the down hole tool 110 is to be set.

In the embodiment of FIGS. 1 through 4, the rupture member 122 is exposed to and delimits the first chamber 114 from a third chamber 124. More specifically, a first side of the rupture member 122 is exposed to the first chamber 114, and a second side of the rupture member 122 is exposed to the third chamber 124. In the illustrated embodiment, the third chamber 124 is defined by a housing 128 having a first end 130 coupled to, for example, a hydraulic pressure transmission coupling 142, and a second end 132 in direct or indirect sealing engagement with the outer radial surface 102*b* of the base pipe 102. The hydraulic pressure transmission coupling 142 defines a conduit 148 that communicates with or is otherwise characterized as the first chamber 114. Examples of other components that may define the conduit 148 include a lower shoe, a crossover component, and the like. The rupture member 122 is located in an end of the conduit 148 and acts as a seal between the first chamber 114 and the third chamber 124 when the rupture member 122 is intact.

In the illustrated embodiment, the third chamber 124 is substantially sealed and is maintained at a reference pressure, such as atmospheric pressure. Those skilled in the art will recognize that the third chamber 124 can be pressurized to substantially any reference pressure calculated based upon the anticipated hydrostatic pressure at a desired depth for setting the tool 110, and the pressure differential threshold value associated with the specific rupture member 122 that is in use. In some embodiments, the third chamber 124 may contain a compressible fluid, such as air or another gas, but in other embodiments may contain other fluids such as, hydraulic fluid, water, oil, combinations thereof, or the like.

As shown in FIGS. 1 and 3, the system 100 may also include a cup assembly 150 having at least one, e.g. two as illustrated, cups 152 located below the ports 120. In exemplary operation, the cups 152 may function as one-way valves within the annulus 108 and permit flow in the up hole direction but substantially prevent or restrict flow in the down hole direction. Components that can be used as the cup 152 include, for example, a swab cup, a single wiper, a modified wiper plug, a modified wiper cup, and the like, each of which can be formed of rubber, foam, plastics, or other suitable materials. By restricting flow in the down hole direction, the cups 152 allow an operator to increase pressure in the annulus 108 while the system 100 remains at substantially the same location within the wellbore 104. The cup assembly 150 and/or the cups 152 can be an integral portion of the system 100 or can be a separate component sealably connected to or with the base pipe 102.

Referring now to FIGS. 2 through 4, as the system 100 is advanced in the wellbore 104, hydrostatic pressure in the annulus 108 generally increases. Pressure in the second chamber 115 also increases due to the fluid communication provided by the ports 120. As pressure in the second chamber 115 increases, hydrostatic equilibrium is maintained between the second chamber 115 and the first chamber 114 by the piston 112 and the seal provided by the intact rupture member 122. Thus, the pressure in the first chamber 114 also increases. On the other hand, pressure in the third chamber 124 may remain substantially the same or may change at a different rate than the pressure in the first chamber 114. As a result, a pressure differential may develop across the rupture member 122. In general, the pressure differential across the rupture member 122 increases as the system is advanced into the wellbore 104.

Depending on the specific application, the down hole tool 110 may be advanced in the wellbore 104 until the hydrostatic pressure in the annulus 108 increases sufficiently to cause the pressure differential to reach the threshold value associated with the rupture member 122, thereby rupturing the rupture member 122. In other applications, the down hole tool 110 can be positioned in the wellbore at a desired location and an operator can operate equipment located above or up hole of the down hole tool 110 to increase the pressure in the annulus 108 until the pressure differential across the rupture member 122 reaches the threshold value.

Regardless of how the pressure differential reaches the threshold value, when the threshold value is reached and the rupture member 122 ruptures, fluid flows from the higher-pressure first chamber 114, through the conduit 148, and into the lower-pressure third chamber 124, thereby reducing the pressure in the first chamber 114. Thus, pressure on the first side 112*c* of the piston portion 112*a* is reduced. Because the second side 112*d* of the piston portion 112*a* is exposed to the hydrostatic pressure in the annulus 108 by way of the second chamber 115 and the ports 120, a pressure differential is created across the piston portion 112*a*. The piston 112 therefore moves axially in direction A as it seeks to regain hydrostatic equilibrium. As the piston 112 moves axially in direction A, the compression sleeve 118 is correspondingly forced up against the second axial end 110*a* of the down hole tool 110, thereby resulting in the compression and radial expansion of the down hole tool 110. As a result, the down hole tool 110 expands radially and engages the wall of the casing 106 to effectively isolate portions of the annulus 108 above and below the down hole tool 110.

Figure 5:
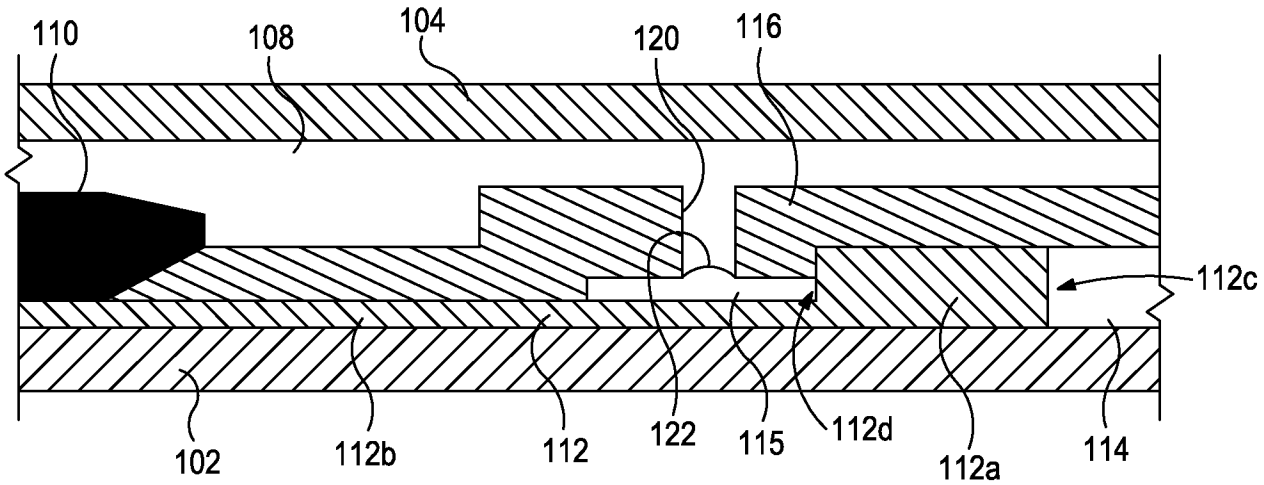
FIG. 5 illustrates an enlarged view of a portion of an alternative embodiment of an activation system, according to one or more embodiments disclosed.

Referring now to FIG. 5, in an alternative embodiment, the rupture member 122 may be located between the port 120 and the second chamber 115. In at least one embodiment, the rupture member 122 may be arranged or otherwise disposed within the port 122. In the embodiment of FIG. 5, for example, there is only one port 120 providing fluid communication between the annulus 108 and the second chamber 115, and that one port 120 has the rupture member 122 located therein. As the system 100 is advanced into the wellbore 104, the first chamber 114 and the second chamber 115 remain in substantial equilibrium while pressure in the port 120 increases as the hydrostatic pressure in the annulus 108 increases. In the embodiment of FIG. 5, the first and second chambers 114, 115 may contain a compressible fluid, such as air or another gas, that is maintained at a reference pressure, such as atmospheric pressure. As discussed previously, the reference pressure can be selected based upon, among other things, the anticipated hydrostatic pressure at a desired depth for setting the tool 110, and the pressure differential threshold value associated with the specific rupture member 122 that is in use. In other embodiments in which the rupture member is located between the port 120 and the second chamber 115, one or both of the first chamber 114 and the second chamber 115 may contain other fluids such as, hydraulic fluid, water, oil, combinations thereof, or the like.

Like the embodiments of FIGS. 1 through 4, the embodiment of FIG. 5 can be advanced into the wellbore 104 until the hydrostatic pressure in the annulus 108 increases such that the pressure differential between the annulus 108 and the second chamber 115 reaches the predetermined threshold value of the rupture member 122. Alternatively, the system 100 can be positioned in the wellbore 104 at a desired location and an operator can increase the pressure in the annulus 108 such that the pressure differential between the annulus 108 and the second chamber 115 reaches the predetermined threshold value of the rupture member 122. Either way, when the pressure differential reaches the predetermined threshold value of the rupture member 122, the rupture member 122 ruptures and the higher pressure fluid in the annulus 108 flows into the lower pressure second chamber 115. Pressure in the second chamber 115 increases, thereby creating a pressure differential across the piston portion 112*a* and causing the piston 112 to move axially in the direction A as it seeks a new fluid equilibrium. Movement of the piston 112 in the direction A sets the down hole tool 110 in the manner discussed above.

Accordingly, the disclosed systems 100 and related methods may be used to remotely set the down hole tool 110. The rupture member 122 activates the setting action of the down hole tool 110 without the need for electronic devices, magnets, or mechanical actuators, but instead relies on pressure differentials between the annulus 108 and various chambers provided in and/or around the tool 110 itself.

In the foregoing description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended due to the details of construction or design herein shown, other than as described in the claims below. It is therefore evident that the particular illustrative embodiments disclosed above may be altered, combined, or modified and all such variations are considered within the scope and spirit of the present invention. In addition, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

What is claimed is:

1. A system for activating a down hole tool in a wellbore, the system comprising:

a piston moveable from a first position to a second position for activating the down hole tool, the piston including a first piston side exposed to a first chamber, and a second piston side exposed to a second chamber, wherein the first and second chambers are defined at least in part by a retainer element arranged about a base pipe; and a rupture member having a first member side exposed to the first chamber and a second member side exposed to a third chamber defined by a housing arranged about the base pipe, the rupture member being configured to prevent fluid communication between the first chamber and the third chamber only until a pressure differential between the first chamber and the third chamber reaches a predetermined threshold value, at which point the rupture member ruptures and allows fluid communication between the first chamber and the third chamber, wherein when the pressure differential is below the threshold value and the rupture member is intact, the piston is in the first position, and wherein when the pressure differential reaches the threshold value and the rupture member ruptures, the piston moves within the first chamber to the second position and activates the down hole tool.

2. The system of claim 1, wherein the piston is axially moveable.

3. The system of claim 1, wherein when the rupture member is intact, the pressure in the first chamber is substantially equal to pressure in the second chamber.

4. The system of claim 1, wherein one of the second chamber and the third chamber is in open fluid communication with a source of variable pressure, and wherein the first chamber and the other of the second chamber and the third chamber are substantially sealed.

5. The system of claim 4, wherein the source of variable pressure is an annulus of the wellbore.

6. The system of claim 5, wherein the system is coupled to the base pipe and is moveable into the wellbore with the base pipe, and wherein as the system is moved deeper into the wellbore, a hydrostatic pressure in the annulus increases, thereby increasing pressure in the second chamber.

7. The system of claim 4, wherein the second chamber is open to the source of variable pressure, and wherein changes in pressure in the second chamber are communicated to the first chamber by way of the piston such that the first chamber and the second chamber remain at substantially the same pressure until the rupture member ruptures.

8. The system of claim 1, wherein the piston is moveable within the first chamber in response to a pressure differential between the first chamber and the second chamber that occurs in response to rupturing of the rupture member.

9. A method for activating a down hole tool in a wellbore, comprising:

advancing the down hole tool into the wellbore to a location in an annulus, the down hole tool being coupled to a base pipe positioned within the wellbore and the base pipe cooperating with an inner surface of the wellbore to define the annulus therebetween;

increasing pressure in the annulus to a pressure above a threshold value, thereby rupturing a rupture member and creating a pressure differential between a first chamber on a first side of a movable piston and a second chamber on a second side of the movable piston, wherein the first and second chambers are defined at least in part by a retainer element arranged about the base pipe;

allowing a fluid to flow from the first chamber into a third chamber upon rupturing the rupture member, the third chamber being defined by a housing arranged about the base pipe, and the rupture member isolating the first and third chambers until the threshold value is reached; and moving the piston in response to the pressure differential to activate the down hole tool.

10. The method of claim 9, wherein increasing pressure in the annulus further comprises preventing fluid flow past a cup assembly located below the down hole tool.

11. The method of claim 9, wherein rupturing the rupture member further comprises opening a fluid communication path between a hydrostatic chamber and an atmospheric chamber.

12. The method of claim 9, wherein moving the piston further comprises moving the piston axially.

13. The method of claim 9, wherein increasing pressure in the annulus further comprises operating equipment located up hole of the down hole tool.

14. A wellbore system, comprising:

a base pipe moveable along the wellbore, the base pipe including a sleeve assembly defining a first chamber, a second chamber, and a third chamber;

a moveable piston fluidly separating the first chamber and the second chamber;

a down hole tool disposed about the base pipe, the down hole tool operatively coupled to the piston and operable in response to movement of the piston; and a rupture member fluidly separating the first chamber from the third chamber only until a pressure differential between the first chamber and the third chamber reaches a predetermined threshold value, at which point the rupture member ruptures and allows fluid communication between the first chamber and the third chamber, thereby reducing pressure in the first chamber and causing the piston to move toward the first chamber to operate the down hole tool.

15. The system of claim 14, further comprising a cup assembly coupled to the base pipe and located below the down hole tool, wherein the cup assembly allows fluid flow past the cup assembly in an up hole direction and restricts fluid flow past the cup assembly in a down hole direction.

16. The system of claim 14, wherein the down hole tool is an annular packer, the system further comprising a compression sleeve movably coupled to the base pipe adjacent the annular packer and coupled to a stem portion of the piston, and wherein movement of the piston toward the first chamber compresses the annular packer with the compression sleeve.

17. The system of claim 14, wherein the second chamber is in open fluid communication with an annulus of the wellbore.

18. The system of claim 14, wherein the rupture member is a burst disc.

* * * * *